US010928781B2

(12) United States Patent
Nagasawa et al.

(10) Patent No.: US 10,928,781 B2
(45) Date of Patent: Feb. 23, 2021

(54) CASE AND TIMEPIECE

(71) Applicant: CASIO COMPUTER CO., LTD., Tokyo (JP)

(72) Inventors: Shouta Nagasawa, Machida (JP); Junichi Sato, Hino (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 291 days.

(21) Appl. No.: 16/045,886

(22) Filed: Jul. 26, 2018

(65) Prior Publication Data

US 2019/0033792 A1 Jan. 31, 2019

(30) Foreign Application Priority Data

Jul. 27, 2017 (JP) ..... JP2017-145328

(51) Int. Cl.
*G04B 37/22* (2006.01)
*G04B 37/00* (2006.01)
*G04G 17/08* (2006.01)

(52) U.S. Cl.
CPC ..... *G04B 37/225* (2013.01); *G04B 37/0008* (2013.01); *G04B 37/22* (2013.01); *G04G 17/08* (2013.01)

(58) Field of Classification Search
CPC .. G04B 37/225; G04B 37/0008; G04B 37/22; G04B 37/18; G04B 37/0058; G04B 37/1486; G04B 37/116; G04B 37/11; G04B 37/086; G04B 37/057; G04G 17/08
USPC ..... 368/280
See application file for complete search history.

(56) References Cited

U.S. PATENT DOCUMENTS

| | | | | |
|---|---|---|---|---|
| 4,620,798 | A | 11/1986 | Scarinzi | |
| 4,742,503 | A | 5/1988 | Braun et al. | |
| 4,995,023 | A | 2/1991 | Müller et al. | |
| 5,233,574 | A | 8/1993 | Walder et al. | |
| 6,657,922 | B2 * | 12/2003 | Sato | G04B 37/12 368/10 |
| 8,500,325 | B2 * | 8/2013 | Ueno | G04B 37/052 368/287 |
| 9,918,541 | B2 | 3/2018 | Byun et al. | |
| 2015/0296963 | A1 | 10/2015 | Byun et al. | |

FOREIGN PATENT DOCUMENTS

| | | |
|---|---|---|
| CN | 104423248 A | 3/2015 |
| GB | 2 309 881 A | 8/1997 |
| JP | S50-072271 U | 6/1975 |

(Continued)

OTHER PUBLICATIONS

First Office Action dated Mar. 19, 2020 received in Chinese Patent Application No. CN 201810837921.1 together with an English language translation.

(Continued)

*Primary Examiner* — Edwin A. Leon
(74) *Attorney, Agent, or Firm* — Scully Scott Murphy & Presser

(57) ABSTRACT

A case including a case body, and an exterior member which is arranged on an outer periphery of the case body in a manner to be deformable in a circumferential direction and which is provided with a separation section for separating at least a part of the case body in the circumferential direction.

6 Claims, 6 Drawing Sheets

(56) References Cited

FOREIGN PATENT DOCUMENTS

| | | | |
|---|---|---|---|
| JP | S60-164288 | A | 8/1985 |
| JP | 2011-249689 | A | 12/2011 |
| JP | 2013-050421 | A | 3/2013 |
| JP | 2015-010905 | A | 1/2015 |
| JP | 2016-176725 | A | 10/2016 |

OTHER PUBLICATIONS

Extended European search report dated Nov. 12, 2018 received in European Patent Application No. EP 18185199.9.
Notification of Reasons for Refusal dated Jun. 20, 2019 received in Japanese Patent Application No. JP 2017-145328 together with an English language translation.
Notice of Reasons for Refusal dated Jan. 6, 2020 received in Japanese Patent Application No. JP 2017-145328 together with an English language translation.

* cited by examiner

CASE AND TIMEPIECE

CROSS-REFERENCE TO RELATED APPLICATION

This application is based upon and claims the benefit of priority from the prior Japanese Patent Application No. 2017-145328, filed Jul. 27, 2017, the entire contents of which are incorporated herein by reference.

BACKGROUND

1. Field of the Invention

The present invention relates to a case that is used for electronic devices such as wristwatches and a timepiece including the same.

2. Description of the Related Art

For example, a shield case for an electronic device is known which has a structure where side plates are provided around a top plate, fixed on a circuit board, and cover electronic components on the circuit board so as to shield the electronic components on the circuit board, as described in Japanese Patent Application Laid-Open (Kokai) Publication No. 2011-249689.

This type of shield case is structured such that, by the side plates having a plurality of slit sections provided over a range from the top plate to an end portion of each side of the side plates located on the opposite side of the top plate, the entire shield case is flexurally deformed by the plurality of slit sections when subjected to a shock due to a drop or the like to mitigate the shock.

However, in the case of this shield case, when the entire shield case is subjected to a shock due to a drop or the like and flexurally deformed by the plurality of slit sections provided on the side plates, stress due to the shock is concentrated on portions of the top plate corresponding to the plurality of slit portions, whereby the top plate is easily damaged.

SUMMARY

In accordance with one embodiment, there is provided a case comprising: a case body; and an exterior member which is arranged on an outer periphery of the case body in a manner to be deformable in a circumferential direction and which is provided with a separation section for separating at least a part of the case body in the circumferential direction.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENT

An embodiment has been applied in a wristwatch will hereinafter be described with reference to FIG. 1 to FIG. 6.

Figure 1:
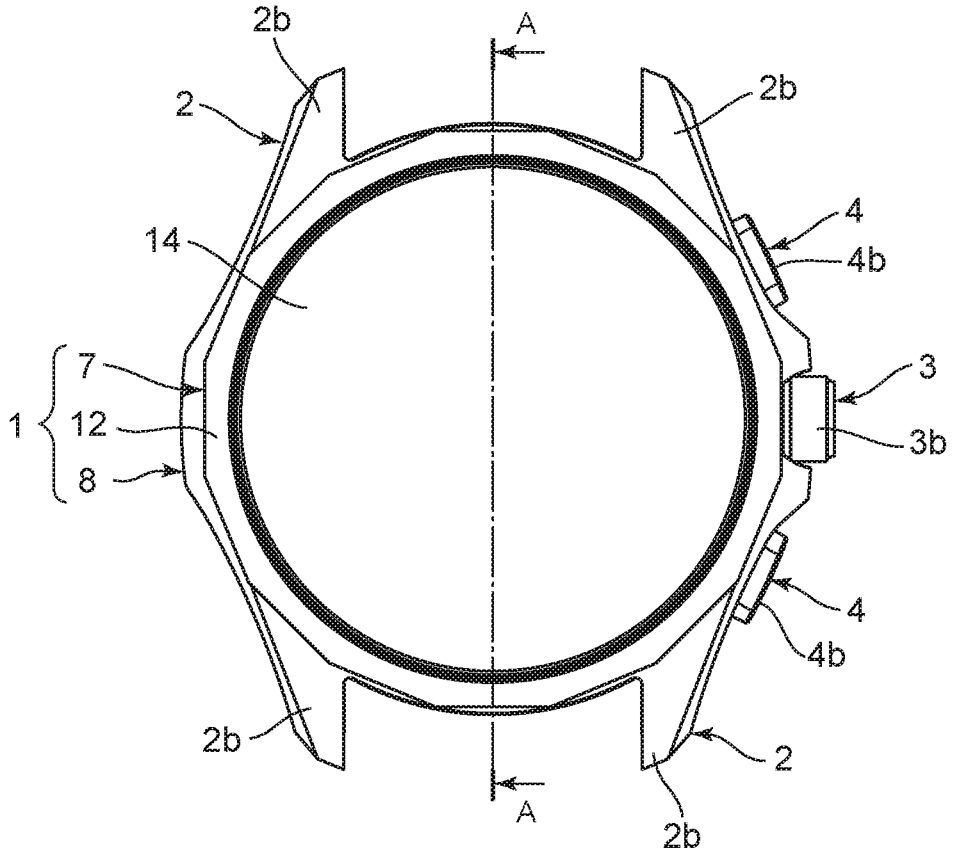
FIG. 1 is a front view showing an embodiment where the present invention has been applied in a wristwatch.
Figure 2:
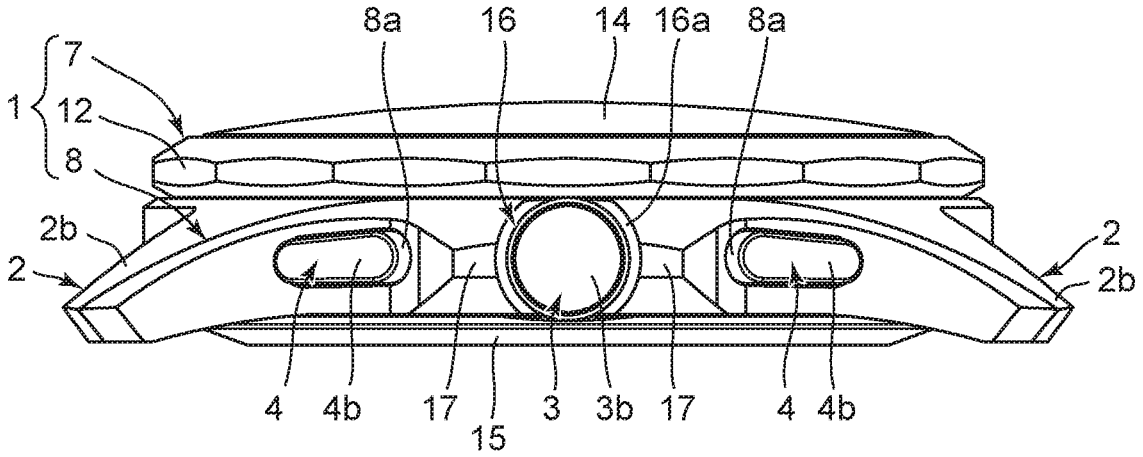
FIG. 2 is an enlarged side view showing the wristwatch shown in FIG. 1 when viewed from the 3 o'clock side.
Figure 3:
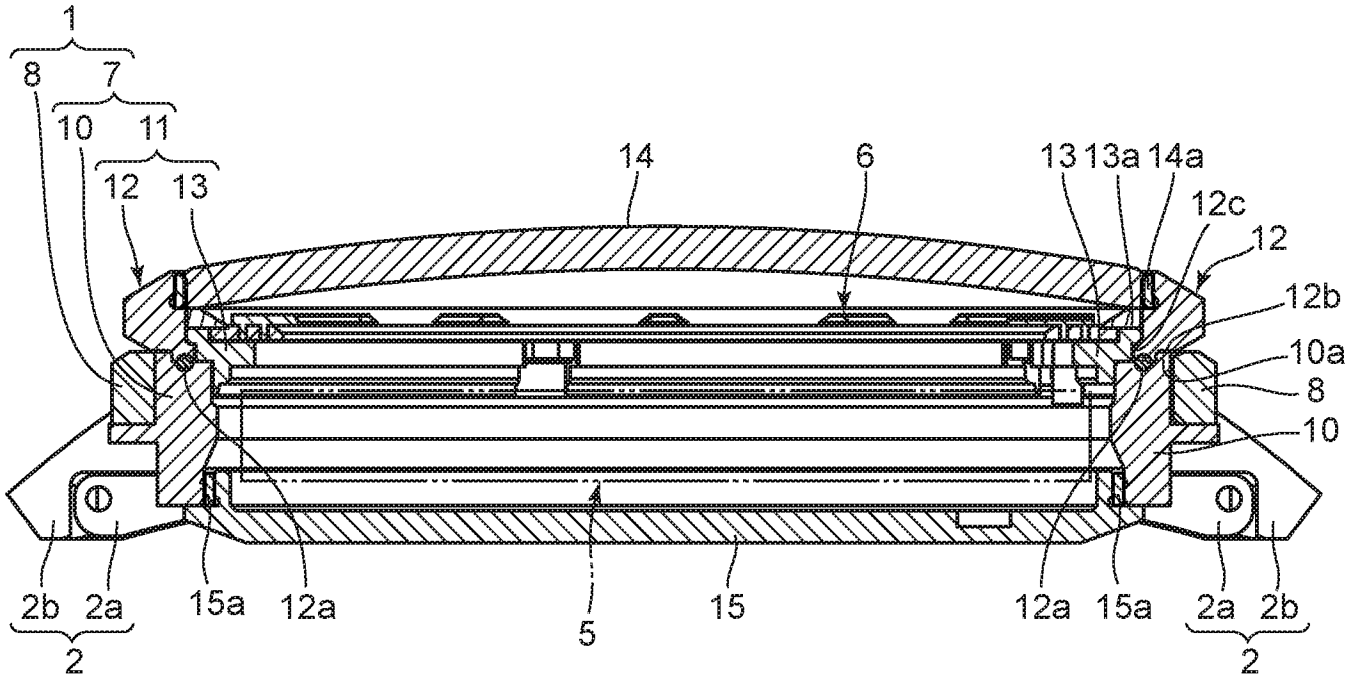
FIG. 3 is an enlarged sectional view taken along line A-A of the wristwatch shown in FIG. 1.

This wristwatch includes a wristwatch case 1, as shown in FIG. 1 to FIG. 3. On the 12 o'clock side and the 6 o'clock side of this wristwatch case 1, band attachment sections 2 are respectively provided. A switch section 3 such as a crown is provided on the 3 o'clock side of the wristwatch case 1, and push-button switches 4 are respectively provided on the 2 o'clock side and the 4 o'clock side of the wristwatch case 1.

As shown in FIG. 3, a timepiece module 5 is arranged inside this wristwatch case 3. This timepiece module 5 includes various types of components (all not shown) required for a timepiece function, such as a timepiece movement which indicates time by moving hands, a display section which electrophotographically displays information regarding time, date, or the like, and a circuit board which drives the display section. Above the timepiece module 5, a ring-shaped parting member 6 is also arranged.

On the other hand, this wristwatch case 1 includes a case body 7 and an exterior case 8 serving as an exterior member, as shown in FIG. 1 to FIG. 4. The case body 7 includes a first case section 10 and a second case section 11. The first case section 10 is formed in a substantially ring shape of hard synthetic resin or metal. The second case section 11 includes an outer case 12 and an inner case 13.

Figure 4:
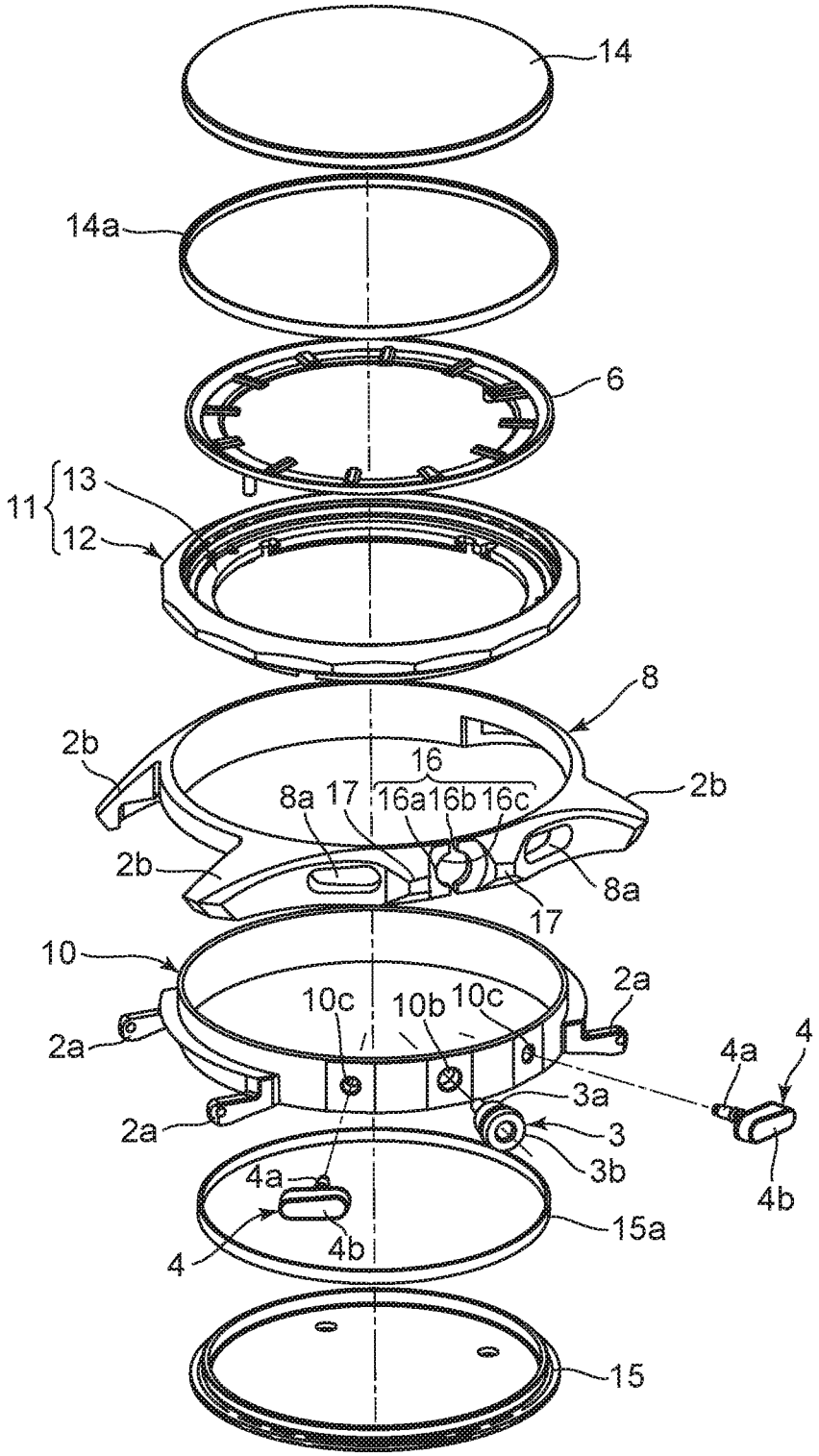
FIG. 4 is an exploded perspective view of the wristwatch shown in FIG. 1.

The outer case 12 in the second case section 11 is formed of hard synthetic resin or metal, as shown in FIG. 3 and FIG. 4. This outer case 12 has its outer diameter larger than the outer diameter of the first case section 10 and its inner diameter larger than the inner diameter of the first case section 10, and is arranged at the upper end of the first case section 10 via a waterproof packing 12*a* formed in a ring shape of a size smaller than the outer diameter of the first case section 10.

The outer case 12 is also formed such that an outer peripheral projection section 10*a* provided on the outer periphery at the upper end of the first case section 10 is fitted into a notch section 12*b* provided on the outer periphery of a lower portion of the outer case 12 when arranged at the upper end of the first case section 10, as shown in FIG. 3 and FIG. 4. As a result, the outer case 12 is structured such that its position in a radial direction is regulated when arranged at the upper end of the first case section 10.

Also, the inner case 13 in the second case section 11 is formed of hard synthetic resin or metal, like the outer case 12, as shown in FIG. 3 and FIG. 4. This inner case 13 is formed in a ring shape having its outer diameter equal to the inner diameter of the outer case 12 and its inner diameter smaller than the inner diameter of the first case section 10.

As a result, the inner case 13 is structured to be fitted into and attached to the inner periphery of an upper portion of the first case section 10 with it protruding into the first case section 10, as shown in FIG. 3 and FIG. 4. Also, the inner case 13 is formed such that its height protruding onto the upper end of the first case section 10 is half or less than the height of the outer case 12 corresponding thereto.

Moreover, the inner case 13 is structured to be inserted into the outer case 12 from thereabove and fitted into the inner periphery of the upper portion of the first case section 10 with the outer case 12 being arranged at the upper end of the first case section 10 via the waterproof packing 12*a*, as shown in FIG. 3 and FIG. 4. As a result, in the inner case 13, a locking section 13*a* provided on its inner peripheral surface presses an inner peripheral projection section 12*c* provided in a lower portion of the inner peripheral surface of the outer case 12 from above so as to fix the outer case 12 to the upper end of the first case section 10.

Also, as shown in FIG. 1 to FIG. 4, a timepiece glass 14 is attached to the upper opening of the case body 7 in this wristwatch case 1, i.e., the upper opening of the outer case 12 in the second case section 11, via a glass packing 14*a*. A rear cover 15 is attached to a lower portion of the case body 7 in this wristwatch case 1, i.e., a lower portion of the first case section 10 via a waterproof ring 15*a*.

Figure 5:
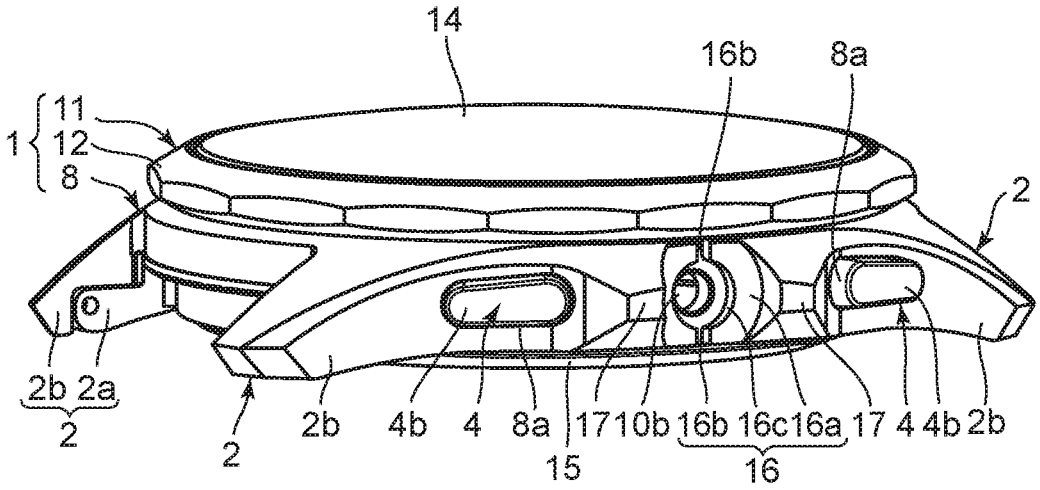
FIG. 5 is an enlarged perspective view showing a state where a switch section on the 3 o'clock side has been removed in the wristwatch shown in FIG. 2.

Also, on the 12 o'clock side and the 6 o'clock side of the outer peripheral surface of the first case section 10 in the case body 7, attachment projection sections 2*a* (band projection sections) in the band attachment section 2 in the wristwatch case 1 are respectively provided protruding outward, as shown in FIG. 3. On the 3 o'clock side of this first case section 10, a switch attachment hole 10*b* which an operation shaft 3*a* in the switch section 3 is inserted into and attached to is provided, as shown in FIG. 4 and FIG. 5. Further, on the 2 o'clock side and the 4 o'clock side of this first case section 10, button attachment holes 10*c* which a button shaft 4*a* in the button switch 4 are respectively inserted into and attached to are respectively provided.

The exterior case 8 is formed in a substantially ring shape of a high hardness material, e.g., ceramics such as zirconium oxide ($ZrO_2$) or aluminum oxide ($Al_2O_3$), as shown in FIG. 1 to FIG. 5. This exterior case 8 is formed to have its inner diameter substantially equal to the outer diameter of the first case section 10 in the case body 7 and its outer diameter substantially equal to the outer diameter of the outer case 12 in the second case section 11 in the case body 7. As a result, the outer case 8 is arranged to be deformable in its circumferential direction with respect to the first case section 10 with it covering the outer periphery of the first case section 10.

On the 12 o'clock side and the 6 o'clock side on the outer peripheral surface of this exterior case 8, cover projection sections 2*b* (cover sections) in the band attachment sections 2 in the wristwatch case 1 are respectively provided, as shown in FIG. 3. The cover projection section 2*b* of the exterior case 8 is formed to cover the attachment projection section 2*a* of the first case section 10 when the exterior case 8 is arranged on the outer periphery of the first case section 10. The cover projection section 2*b* is also formed such that, when it covers the attachment projection section 2*a* of the first case section 10, a gap is formed in the circumferential direction of the exterior case 8 between the inner surface of the cover projection section 2*b* and the outer surface of the attachment projection section 2*a*.

Figure 6:
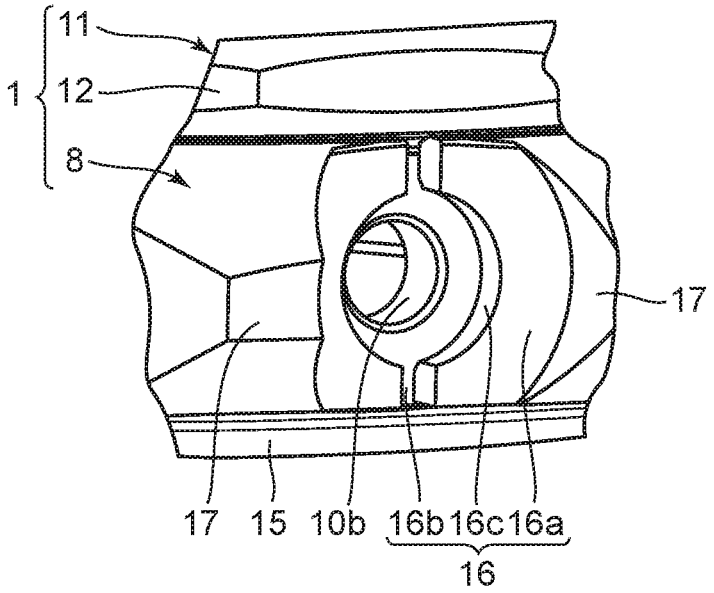
FIG. 6 is an enlarged perspective view of the main section, which shows a separation section in an exterior member positioned on the 3 o'clock side of the wristwatch shown in FIG. 5.

Also, this exterior case 8 has a separation section 16 for separating the exterior case 8 in the circumferential direction thereof provided at its portion corresponding to the 3 o'clock side of the first case section 10 on which the switch section 3 is provided, as shown in FIG. 4 to FIG. 6. This exterior case 8 also has a pair of protection projection sections 17 for protecting an operation head section 3*b* of the switch section 3 respectively provided to protrude in a mountain shape on both sides in the circumferential direction of the separation section 16.

The separation section 16 in this exterior case 8 includes a substantially circular recess section 16*a* provided on the outer peripheral surface of the exterior case 8, a slit 16*b* provided in this recess section 16*a* for separating the exterior case 8 in the circumferential direction thereof, and a switch insertion hole 16*c* provided in a central portion of the recess section 16*a*, as shown in FIG. 4 to FIG. 6.

Also, the recess section 16*a* in the separation section 16 has a diameter substantially equal to the length of the exterior case 8 in the direction perpendicular to the circumferential direction, i.e., the length of the first case section 10 in the height direction (the length in the vertical direction in FIG. 5) and is formed in a substantially circular mortar shape in a depressed state between the pair of protection projection sections 17, as shown in FIG. 4 to FIG. 6.

The slit 16*b* is provided over a range from the upper end to the lower end of the exterior case 8 through the central portion of the recess section 16*a* in the direction perpendicular to the circumferential direction of the exterior case 8, i.e., the height direction (the vertical direction in FIG. 5) of the first case section 10, as shown in FIG. 5 to FIG. 6. That is, the slit 16*b* is to make the exterior case 8 deformable in the circumferential direction of the exterior case 8 with the exterior case 8 being arranged on the outer periphery of the first case section 10, and has a width in the circumferential direction smaller than the outer diameter of the operation shaft 3*a* in the switch section 3.

Also, the switch insertion hole 16*c* is a circular hole in which the columnar operation head section 3*b* of the switch section 3 is rotatably arranged, and is provided with it penetrating through the central portion of the recess section 16*a*, as shown in FIG. 4 to FIG. 6. Accordingly, the slit 16*b* is provided with it being divided into an upper side and a lower side of the switch insertion hole 16*c*.

This switch insertion hole 16*c* has its inner diameter slightly larger than the outer diameter of the operation head section 3*b* of the switch section 3, as shown in FIG. 4 to FIG. 6. Accordingly, when the operation head section 3*b* of the switch section 3 is arranged, a gap is formed between the outer peripheral surface of the operation head section 3*b* and the inner peripheral surface of the switch insertion hole 16*c*. Also, the switch insertion hole 16*c* is provided corresponding to the switch attachment hole 10*b* in the first case section 10 such that its central axis matches a central axis of the switch attachment hole 10*b* in the first case section 10.

As a result, the switch section 3 is structured such that the operation head section 3*b* is inserted into the switch insertion hole 16*c* in the exterior case 8 and exposed to the outside with the operation shaft 3*a* being inserted into and attached to the switch attachment hole 10*b* in the first case section 10, as shown in FIG. 4 to FIG. 6. The switch section 3 is also structured such that the operation head section 3*b* does not come in contact with the inner peripheral surface of the switch insertion hole 16*c* by the gap formed between the outer peripheral surface of the operation head section 3*b* and the inner peripheral surface of the switch insertion hole 16*c* even when the exterior case 8 is displaced in the circumferential direction thereof.

On the 2 o'clock side and the 4 o'clock side of this exterior case 8, button insertion holes 8*a* into which a button head section 4*b* in the push-button switch 4 has been inserted are respectively provided coaxially with the button attachment holes 10*c* in the first case section 10, as shown in FIG. 2 to FIG. 5. On the other hand, the button head section 4*b* in the push-button switch 4 is formed in a substantially rectangular shape which is long in the circumferential direction on the outer peripheral surface of the wristwatch case 1. Accordingly, the button insertion hole 8*a* is formed in a substantially rectangular shape which is slightly longer in the circumferential direction of the exterior case 8 than the button head section 4*b* in the push-button switch 4.

That is, this button insertion hole 8*a* is formed to have a gap having substantially the same dimension as the width of the slit 16*b* in the separation section 16 provided between itself and both ends of the button head section 4*b* in the circumferential direction of the exterior case 8 with the button head section 4*b* in the push-button switch 4 being arranged therein, as shown in FIG. 4 and FIG. 5. As a result, the push-button switch 4 is structured such that both ends of the button head section 4*b* do not come in contact with the inner surface of the button insertion hole 8*a* even when the exterior case 8 is displaced in the circumferential direction thereof with the button head section 4*b* being arranged in the button insertion hole 8*a* in the exterior case 8.

Next, the mechanism of this wristwatch is described.

In the assembly of the wristwatch case 1, the exterior case 8 is first attached to the outer periphery of the first case section 10 in the case body 7. Here, the slit 16*b* and the switch insertion hole 16*c* in the separation section 16 are provided on the 3 o'clock side of the exterior case 8, whereby the exterior case 8 can be pushed out in the circumferential direction thereof. Accordingly, the exterior case 8 can be smoothly and favorably fitted into the outer periphery of the first case section 10 from above the first case section 10.

Here, the cover projection sections 2*b* in the exterior case 8 are respectively made to correspond to the attachment projection sections 2*a* on the 12 o'clock side and the 6 o'clock side of the first case section 10 so as to cover the attachment projection sections 2*a* in the first case section 10. Here, a gap having substantially the same dimension as the width of the slit 16*b* in the separation section 16 in the exterior case 8 is formed in the circumferential direction of the exterior case 8 between the inner surface of the cover projection section 2*b* of the exterior case 8 and the outer surface of the attachment projection section 2*a* of the first case section 10. As a result, the band attachment section 2 in the wristwatch case 1 is formed.

Also, here, the switch insertion hole 16*c* in the separation section 16 in the exterior case 8 is positioned coaxially with the switch attachment hole 10*b* in the first case section 10 and the button insertion hole 8*a* in the exterior case 8 is positioned coaxially with the button attachment hole 10*c* in the first case section 10. As a result, the exterior case 8 is attached with it being deformable in the circumferential direction thereof on the outer periphery of the first case section 10.

The second case section 11 is attached to the upper end of the first case section 10 so as to assemble the case body 7. Here, the waterproof packing 12*a* is first arranged at the upper end of the first case section 10 and the outer case 12 in the second case section 11 is arranged at the upper end of the first case section 10. Here, the notch section 12*b* provided on the outer periphery of the lower portion of the outer case 12 is fitted into the outer peripheral projection section 10*a* provided on the outer periphery at the upper end of the first case section 10. As a result, the outer case 12 is arranged at the upper end of the first case section 10 with the position in the radial direction regulated.

In this state, the inner case 13 in the second case section 11 is inserted into the outer case 12 from thereabove, and is fitted into the inner periphery of the upper portion of the first case section 10. Here, the locking section 13*a* provided on the inner peripheral surface of the inner case 13 presses the inner peripheral projection section 12*c* provided in the lower portion of the inner peripheral surface of the outer case 12 from above. Accordingly, the outer case 12 is fixed with it being pressed against the upper end of the first case section 10 via the waterproof packing 12*a*. As a result, the second case section 11 is assembled on the first case section 10, whereby the wristwatch case 1 is assembled.

When the timepiece glass 14 is to be attached to this wristwatch case 1, the ring-like parting member 6 is first inserted into the outer case 12 from thereabove, and arranged on the inner case 13. In this state, the timepiece glass 14, together with the glass packing 14*a*, is fitted into and attached to an upper portion of the outer case 12. Then, the timepiece module 5 is arranged within the first case section 10 in the case body 7 from below the wristwatch case 1.

In this state, the switch section 3 is attached to the 3 o'clock side of the wristwatch case 1 and the push-button switches 4 are respectively attached to the 2 o'clock side and the 4 o'clock side thereof. That is, when the switch section 3 is to be attached, the operation shaft 3*a* is inserted into and attached to the switch attachment hole 10*b* in the first case section 10 from the switch insertion hole 16*c* in the separation section 16 in the exterior case 8 while the operation head section 3*b* is inserted into the switch insertion hole 16*c* in the separation section 16 in the exterior case 8 and exposed to the outside of the wristwatch case 1.

Here, a gap having substantially the same dimension as the width in the circumferential direction of the exterior case 8 of the slit 16*b* in the separation section 16 in the exterior case 8 is formed between the inner peripheral surface of the switch insertion hole 16*c* in the separation section 16 in the exterior case 8 and the outer peripheral surface of the operation head section 3*b* of the switch section 3. As a result, the switch section 3 is attached to the 3 o'clock side of the wristwatch case 1.

Also, when the push-button switch 4 is to be attached to the wristwatch case 1, the button shaft 4*a* is inserted into and attached to the button attachment hole 10*c* in the first case section 10 from the button insertion hole 8*a* in the exterior case 8 and the button head section 4*b* is inserted into the button insertion hole 8*a* in the exterior case 8 and exposed to the outside of the wristwatch case 1.

Here, a gap having substantially the same dimension as the width of the slit 16*b* in the separation section 16 is formed between the ends of the button head section 4*b* in the circumferential direction of the exterior case 8 and the inner surface of the button insertion hole 8*a* corresponding thereto. As a result, the push-button switches 4 are respectively attached to the 2 o'clock side and the 4 o'clock side of the wristwatch case 1. The rear cover 15 is attached to the lower portion of the wristwatch case 1, i.e., the lower portion of the first case section 10 so as to press and fix the timepiece module 5 into and to the wristwatch case 1. As a result, the wristwatch is assembled.

In the assembled wristwatch, when the exterior case 8 in the wristwatch case 1 is subjected to a shock due to a drop or the like, the exterior case 8 is displaced in the circumferential direction thereof in accordance with the strength of its shock force. That is, even though the exterior case 8 is formed of a high hardness material such as ceramics, the separation section 16 for separating the exterior case 8 in the circumferential direction thereof is provided in the portion where the switch section 3 on the 3 o'clock side is arranged, whereby the exterior case 8 can be displaced in the circumferential direction thereof by the separation section 16 when subjected to a shock due to a drop or the like.

That is, the separation section 16 in the exterior case 8 includes the slit 16*b* provided over the range from the upper end to the lower end positioned in the direction perpendicular to the circumferential direction of the exterior case 8, and the switch insertion hole 16*c* provided in the central portion of this slit 16*b*. Accordingly, when the exterior case 8 is subjected to a shock due to a drop or the like, the slit 16*b* and the switch insertion hole 16*c* in the separation section 16 can reliably and favorably displace the exterior case 8 in the circumferential direction thereof in accordance with the strength of the shock force.

Therefore, even if the exterior case 8 is subjected to a shock, generation of stress due to the shock can be dispersed, whereby the shock to which the exterior case 8 has been subjected can be mitigated. As a result, even if the exterior case 8 is subjected to a shock, the exterior case 8 can be prevented from being damaged. In this case, even if the exterior case 8 is displaced in the circumferential direction by being subjected to the shock, the band attachment section 2, the switch section 3, and the push-button switch 4 are prevented from being affected by the displacement in the circumferential direction of the exterior case 8.

That is, in the band attachment section 2, when the cover projection section 2*b* of the exterior case 8 covers the attachment projection section 2*a* of the first case section 10, a gap having substantially the same dimension as the width of the slit 16*b* in the separation section 16 in the exterior case 8 is formed in the circumferential direction of the exterior case 8 between the inner surface of the cover projection section 2*b* of the exterior case 8 and the outer surface of the attachment projection section 2*a* of the first case section 10.

As a result, even when the exterior case 8 is displaced in the circumferential direction by being subjected to a shock, the inner surface of the cover projection section 2*b* of the exterior case 8 and the outer surface of the attachment projection section 2*a* of the first case section 10 do not come in contact with each other. Accordingly, even if the exterior case 8 is subjected to a shock, the band attachment section 2 can be prevented from being damaged.

Also, in the switch section 3, a gap having substantially the same dimension as the width of the slit 16*b* in the separation section 16 in the exterior case 8 is formed in the circumferential direction of the exterior case 8 between the inner peripheral surface of the switch insertion hole 16*c* in the separation section 16 in the exterior case 8 and the outer peripheral surface of the operation head section 3*b* of the switch section 3. Accordingly, even if the exterior case 8 is displaced in the circumferential direction by being subjected to a shock, the inner peripheral surface of the switch insertion hole 16*c* in the exterior case 8 and the outer peripheral surface of the operation head section 3*b* of the switch section 3 do not come in contact with each other. Thus, even if the exterior case 8 is subjected to a shock, the switch section 3 can be prevented from being damaged.

Furthermore, the button insertion hole 8*a* in the exterior case 8 where the button head section 4*b* in the push-button switch 4 is arranged is formed to be longer in the circumferential direction of the exterior case 8 than the button head section 4*b* in the push-button switch 4. Accordingly, a gap having substantially the same dimension as the width of the slit 16*b* in the separation section 16 is formed between both ends of the button head section 4*b* in the circumferential direction of the exterior case 8 and both sides of the button insertion hole 8*a* corresponding thereto, in the circumferential direction of the exterior case 8.

As a result, even when the exterior case 8 is displaced in the circumferential direction by being subjected to a shock, both ends of the button head section 4*b* in the circumferential direction of the exterior case 8 and both sides of the button insertion hole 8*a* corresponding thereto can be prevented from coming in contact with each other. Accordingly, even if the exterior case 8 is subjected to a shock, the push-button switch 4 can be prevented from being damaged.

As such, this wristwatch includes the case body 7 and the exterior case 8 which is arranged on the outer periphery of the case body 7 and is provided with the separation section 16 for separating a part in the circumferential direction thereof of the case body 7. As a result, when the exterior case 8 is subjected to a shock due to a drop or the like, the exterior case 8 can be displaced in the circumferential direction thereof by the separation section 16. As a result, the shock can be mitigated, whereby the exterior case 8 can be prevented from being damaged by the shock.

That is, in this wristwatch, the exterior case 8 which is provided with the separation section 16 is arranged to be deformable in the circumferential direction on the outer periphery of the case body 7. As a result, when the exterior case 8 is subjected to a shock due to a drop or the like, the exterior case 8 can be displaced in the circumferential direction in accordance with the strength of the shock. Thus, generation of stress due to a shock in the exterior case 8 can be favorably dispersed. As a result, the shock can be favorably mitigated, whereby the exterior case 8 can be prevented from being damaged by the shock.

In this embodiment, the separation section 16 in the exterior case 8 is provided corresponding to the portion on the 3 o'clock side of the case body 7 on which the switch section 3 is provided. Accordingly, even though the separation section 16 is provided in the exterior case 8, by the case body 7 being provided with the switch section 3, the separation section 16 can be hidden not to be seen from the outside by the operation head section 3*b* of the switch section 3. As a result, even though the exterior case 8 is provided with the separation section 16, the outer appearance of the wristwatch case 1 is not degraded, whereby the design of the wristwatch case 1 can be enhanced.

Also, the separation section 16 includes the slit 16*b* for separating the exterior case 8 in the circumferential direction thereof and the switch insertion hole 16*c* which is provided in the central portion of the slit 16*b* and into which the operation head section 3*b* of the switch section 3 is inserted. As a result, when the exterior case 8 is subjected to a shock due to a drop or the like, the exterior case 8 can be reliably and favorably displaced in the circumferential direction thereof in response to its shock force by the slit 16*b* and the switch insertion hole 16*c* in the separation section 16 provided in the exterior case 8.

Also, the inner diameter of the switch insertion hole 16*c* is larger than the outer diameter of the operation head section 3*b* of the switch section 3. Accordingly, the operation head section 3*b* of the switch section 3 can be easily and favorably arranged within the switch insertion hole 16*c* while the operation head section 3*b* of the switch section 3 can be favorably exposed to the outside of the exterior case 8 from inside the switch insertion hole 16*c*. As a result, the operation head section 3*b* of the switch section 3 can be reliably and favorably operated.

Also, since the inner diameter of the switch insertion hole 16*c* is larger than the outer diameter of the operation head section 3*b* of the switch section 3, a gap having substantially the same dimension as the width of the slit 16*b* can be formed between the inner peripheral surface of the switch insertion hole 16*c* and the outer peripheral surface of the operation head section 3*b* of the switch section 3. Accordingly, even when the exterior case 8 is displaced in the circumferential direction by being subjected to a shock, the inner peripheral surface of the switch insertion hole 16*c* in the exterior case 8 and the outer peripheral surface of the operation head section 3*b* of the switch section 3 do not come in contact with each other. Thus, even if the exterior case 8 is subjected to a shock, the switch section 3 can be prevented from being damaged.

Also, in this wristwatch case 1, the case body 7 is provided with the push-button switch 4 that is a switch section other than the switch section 3. In addition, in the exterior case 8, the button insertion hole 8*a*, which is an attachment hole into which the button head section 4*b* in the push-button switch 4 is inserted, is formed to be longer in the circumferential direction of the exterior case 8 than the button head section 4*b* in the push-button switch 4. As a result, the button head section 4*b* in the push-button switch 4 can be easily and favorably arranged within the button insertion hole 8*a* and the button head section 4*b* in the push-button switch 4 can be reliably and favorably operated.

Furthermore, since the exterior case 8 has the button insertion hole 8*a* formed to be longer in the circumferential direction of the exterior case 8 than the button head section 4*b* in the push-button switch 4, a gap having substantially the same dimension as the width of the slit 16*b* can be formed between both ends of the button head section 4*b* in the circumferential direction of the exterior case 8 and both sides of the button insertion hole 8*a* corresponding thereto, in the circumferential direction of the exterior case 8. Accordingly, even when the exterior case 8 is displaced in the circumferential direction by being subjected to a shock, both ends of the button head section 4*b* and both sides of the button insertion hole 8*a* can be prevented from coming in contact with each other. Thus, even if the exterior case 8 is subjected to a shock, the push-button switch 4 can be prevented from being damaged.

Furthermore, in this wristwatch case 1, the band attachment section 2 includes the attachment projection section 2*a* of the first case section 10 and the cover projection section 2*b* of the exterior case 8 which covers this attachment projection section 2*a*. As a result, the cover projection section 2*b* can cover the attachment projection section 2*a* and, by this cover projection section 2*b* of the exterior case 8, the band attachment section 2 is not easily damaged. As a result, the design of the wristwatch case 1 can be enhanced.

Also, when the cover projection section 2*b* of the exterior case 8 covers the attachment projection section 2*a* of the first case section 10, a gap having substantially the same dimension as the width of the slit 16*b* in the exterior case 8 is formed in the circumferential direction of the exterior case 8 between the inner surface of the cover projection section 2*b* and the outer surface of the attachment projection section 2*a*. As a result, even when the exterior case 8 is displaced in the circumferential direction by being subjected to a shock, the inner surface of the cover projection section 2*b* of the exterior case 8 and the outer surface of the attachment projection section 2*a* of the first case section 10 do not come in contact with each other. Thus, even if the exterior case 8 is subjected to a shock, the band attachment section 2 can be prevented from being damaged.

Also, in this wristwatch case 1, the exterior case 8 is formed of ceramics such as zirconium oxide ($ZrO_2$) or aluminum oxide ($Al_2O_3$), whereby the hardness of the exterior case 8 can be increased. As a result, the surface of the exterior case 8 can be prevented from being easily damaged. Thus, the design of the wristwatch case 1 is excellent, and the quality thereof can be maintained.

In this embodiment, ceramics is a brittle material and therefore is easily damaged when subjected to a shock. However, when the exterior case 8 using this ceramics is subjected to a shock, the exterior case 8 is displaced in the circumferential direction thereof by the slit 16*b* and the switch insertion hole 16*c* in the separation section 16, so that the generation of stress due to the shock can be dispersed, and the shock can be mitigated. Thus, the exterior case 8 can be prevented from being damaged by the shock.

In the above-described embodiment, the separation section 16 is provided on the 3 o'clock side of the exterior case 8. However, the separation section 16 in the present invention is not necessarily required to be provided on the 3 o'clock side, and may be provided anywhere in the exterior case 8. Also, the separation section 16 is not required to be provided in one portion of the exterior case 8, and may be provided in a plurality of portions of the exterior case 8. For example, the separation section 16 may be further provided at a position on the 9 o'clock side opposite to the 3 o'clock side.

Also, in the above-described embodiment, the separation section 16 is structured to include the recess section 16*a*, the slit 16*b*, and the switch insertion hole 16*c*. However, the present invention is not limited thereto. For example, the separation section 16 may have a structure including only the slit 16*b*.

Moreover, in the above-described embodiment, the second case section 11 in the case body 7 is structured to include the outer case 12 and the inner case 13. However, the present invention is not limited thereto. For example, the second case section 11 may have a structure where the outer case 12 and the inner case 13 are integrally formed. Also, the case body 7 is not necessarily required to be constituted by the first case section 10 and the second case section 11, and may have a structure where the first case section 10 and the second case section 11 are integrally formed.

Furthermore, in the above-described embodiment, the present invention has been applied in a wristwatch. However, the present invention is not necessarily required to be applied in a wristwatch, and is applicable to various types of timepieces such as a travel watch, an alarm clock, a table clock, and a wall clock. In addition, the present invention is not necessarily required to be applied in a timepiece, and is applicable to respective cases of electronic devices such as a mobile phone and a personal digital assistant.

While the present invention has been described with reference to the preferred embodiments, it is intended that the invention be not limited by any of the details of the description therein but includes all the embodiments which fall within the scope of the appended claims.

What is claimed is:

1. A case comprising:

a case body;

a switch; and an exterior member arranged on an outer periphery of the case body in a manner such that in a first arrangement, a first inner peripheral surface of the exterior member is separated from and faces a second inner peripheral surface of the exterior member in a circumferential direction of the exterior member, wherein in a second arrangement, the exterior member is deformable in the circumferential direction to move the first inner peripheral surface and the second inner peripheral surface closer to each other, wherein the first inner peripheral surface and the second inner peripheral surface are provided to correspond to a portion of the case body to which the switch is provided, wherein in the first arrangement, the first inner peripheral surface and the second inner peripheral surface are separated to define a first slit, a second slit and an insertion hole between the first slit and the second slit in which a head section of the switch is arranged, wherein an inner diameter of the insertion hole in the circumferential direction is greater than widths of each of the first slit and the second slit in the circumferential direction, and wherein the inner diameter of the insertion hole and an outer diameter of the head section of the switch are dimensioned such that even when the exterior member is deformed in the circumferential direction such that portions of the first inner peripheral surface and the second inner peripheral surface defining the first slit and the second slit are brought into contact with each other, a gap is provided between portions of the first inner peripheral surface and the second inner peripheral surface defining the insertion hole and an outer peripheral surface of the head section of the switch arranged in the insertion hole.

2. The case according to claim 1, wherein the inner diameter of the insertion hole in the circumferential direction is greater than the outer diameter of the head section of the switch section.

3. The case according to claim 1, further comprising:

another switch, wherein the exterior member defines an attachment hole in which a head section of the another switch is arranged, and wherein the exterior member and the another switch are formed such that a length of the attachment hole in the circumferential direction is greater than an outer diameter of the head section of the another switch.

4. The case according to claim 1, further comprising:

wherein the case body comprises a band projection section configured to protrude outwardly, and wherein the exterior member comprises a cover section configured to cover the band projection section such that a gap is provided in the circumferential direction of the exterior member between an inner surface of the cover section and an outer surface of the band projection section.

5. The case according to claim 1, wherein the exterior member is formed of ceramics.

6. A timepiece comprising the case according to claim 1.

* * * * *